114-253 SR
5/20/86 XR 4,589,366

United States Patent [19]

Eiber

[11] Patent Number: 4,589,366

[45] Date of Patent: May 20, 1986

[54] SKI PYLON

[76] Inventor: Kevin J. Eiber, 3931 Lake Vista Rd., Akron, Ohio 44319

[21] Appl. No.: 641,758

[22] Filed: Aug. 17, 1984

[51] Int. Cl.[4] ..... B63B 17/00

[52] U.S. Cl. ..... 114/363; 114/253; 114/364

[58] Field of Search ..... 114/253, 363, 364, 361; 440/109

[56] References Cited

U.S. PATENT DOCUMENTS

| | | | |
|---|---|---|---|
| 913,457 | 2/1909 | Bestman | 440/109 |
| 3,106,931 | 10/1963 | Cooper | 114/361 |
| 3,949,698 | 4/1976 | Sell | 114/253 |
| 4,425,863 | 1/1984 | Cutler | 114/363 |
| 4,428,617 | 1/1984 | Lawson | 114/363 |

FOREIGN PATENT DOCUMENTS

| | | | |
|---|---|---|---|
| 648867 | 11/1962 | Italy | 114/253 |

OTHER PUBLICATIONS

Ski Tow Pylon, from "Boats" magazine, Mar. 1960, p. 9.

Deck Plates, from "Marine Products" catalog by Marine Equipment and Supply Co., 1983, p. 187.

*Primary Examiner*—Sherman D. Basinger
*Assistant Examiner*—Thomas J. Brahan
*Attorney, Agent, or Firm*—Oldham, Oldham, & Weber Co.

[57] ABSTRACT

A water ski tow assembly comprising a capped pylon and a mounting base plate wherein the base plate is mounted to the inside of the boat floor. Additionally, the pylon can be of a two-piece construction wherein a fishing seat can be attached to the base of the two-piece pylon.

8 Claims, 7 Drawing Figures

SKI PYLON

TECHNICAL FIELD

The present invention relates to the fields of water skiing and pleasure fishing. In the past, the usual procedure for attaching ski ropes to a boat was by some form of transom-mounted connection. This has resulted in several problems. First and foremost is the fact that the ski rope inevitably ends up entangled in the boat's propeller. A second problem is that, while attaching the rope to the transom, boaters had a tendency to find the water more quickly than they anticipated by falling overboard during the attachment procedures. The present invention alleviates these problems entirely by bringing the rope mount inside the boat, eliminating rope entanglement and unnecessary swimming.

BACKGROUND ART

The prior art has taught various methods of ski rope attachments. However, most, if not all of the prior art relates to a transom or rear end ski rope attachment process. U.S. Pat. No. 3,034,470, to Vanderfeltz, teaches a rearwardly located structure mounted above the transom. U.S. Pat. No. 4,213,413, to Courtney, teaches a half-circular structure encompassing the motor and being attached to the rear end of the boat with a sliding mechanism allowing skiers to rotate around the boat. U.S. Pat. No. 3,919,963, to Cox, teaches a davit mounted to the transom which is combined with a winch mechanism to pay in and pay out slack in the rope. U.S. Pat. No. 3,949,698, to Sell, similar to the Vanderfeltz patent, also teaches a structure located on the transom for pulling skiers. Finally, U.S. Pat. No. 3,294,053, to Emery, shows a mechanism for holding a plurality of ski ropes.

DISCLOSURE OF INVENTION

It is an object of the present invention to relocate the attachment surface of the ski rope from the boat transom to the boat floor.

Another object of the present invention is to have an easy-in, easy-out pylon so that when not in use it can be conveniently stored.

Yet another object of the present invention is a mounting plate flushly mounted to the boat floor.

Still another object of the present invention is a cap which enables a plurality of ski ropes to be attached to the pylon.

Yet another object of the present invention is versatility, whereby it can be converted from a ski pylon to a fishing chair.

BRIEF DESCRIPTION OF DRAWINGS

For a complete understanding of the objects and structure of the invention, reference should be had to the following detailed description and accompanying drawings, wherein.

BEST MODE FOR CARRYING OUT THE INVENTION

Figure 1:
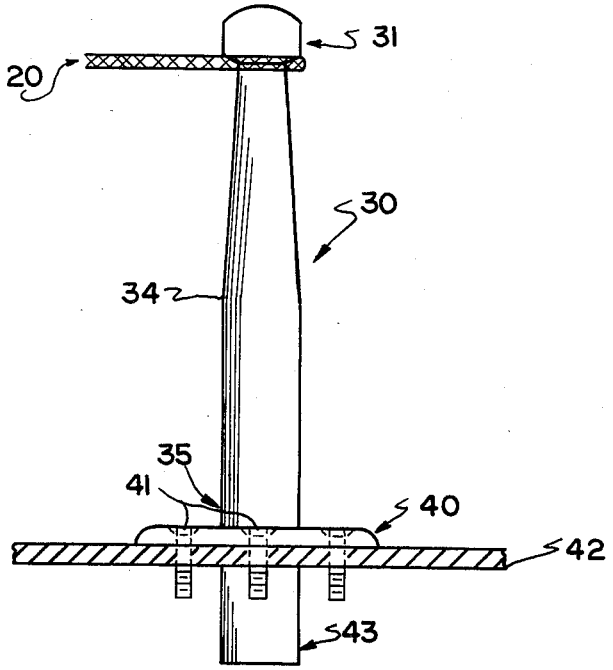
FIG. 1 is a front view of the pylon.

FIG. 1 illustrates a front view of the pylon 30 of the invention. The pylon 30 is preferably a long, slender, cylindrically shaped, resilient, machined member. It may be of either solid or hollow construction, but preferably hollow for economy. The pylon 30 is tapered from its base 35 to its hemispherical cap 31 at its apex. The pylon 30 can vary in height, diameter, and geometric configuration, such as a polygonal design, depending upon the type of boat in which the pylon is being installed. The pylon 30 can simultaneously accommodate a plurality of ski ropes 20, with the cap 31 serving as a stop for preventing the ropes 20 from slipping off. The pylon 30 is usually machined from aluminum, but could be made of any non-oxidizing metal or alloy, and could conceivably be molded of certain strong plastic material.

Figure 2:
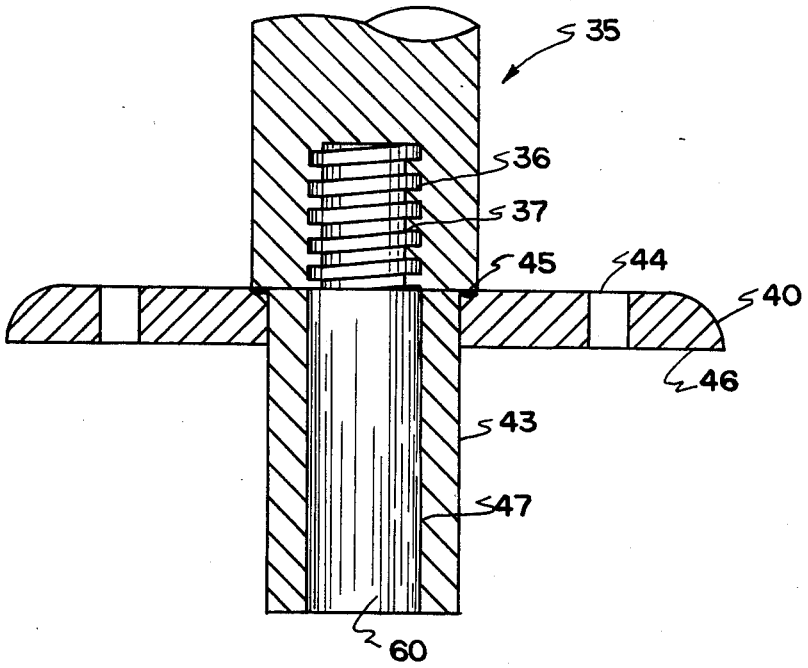
FIG. 2 is a fragmentary cross-sectional view of the mounting apparatus.

FIG. 2 illustrates the mounting of the pylon 30. A solid pylon base 35 has a female thread 36 formed in the bottom thereof. A cylindrical pylon pin 60 has male threads 37 on one end thereof and none on the other. The threads 37 of the pin 60 are first mated with the pylon threads 36, with the major portion of the pin 60 extending from the pylon base 36. The pin 60 and pylon 30 are inserted into the mounting base plate 40. The mounting base plate 40 is comprised of a circular ring member 46 having therein a plurality of equally spaced holes 44 for bolting the ring 46 onto the boat floor. Also included is a mounting sleeve 43 attached to the ring by conventional means, such as welding. The mounting sleeve 43 defines a bore 47 in its center which accommodates the pin 60. The pin 60 and bore 47 mate by a tight slip fit which holds the pylon 30 in place, rendering it ready for ski ropes 20.

Figure 3:
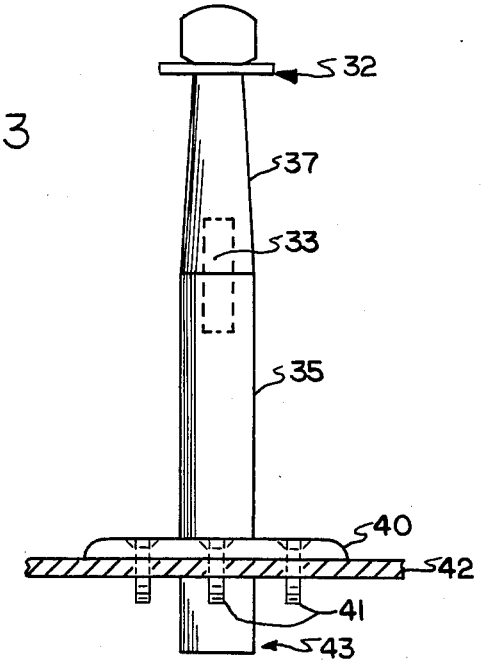
FIG. 3 is a front view of the two-piece pylon.

FIG. 3 illustrates a two-piece pylon 30. A pin 33 holds the top piece 37 and base 35 together by threaded engagement therebetween. The top piece 37 is cylindrical with a threaded bore in its bottom, while the base 35 is cylindrical with a threaded bore in its top. The pin 33 is continuously threaded to attain the desired engagement.

Figure 4:
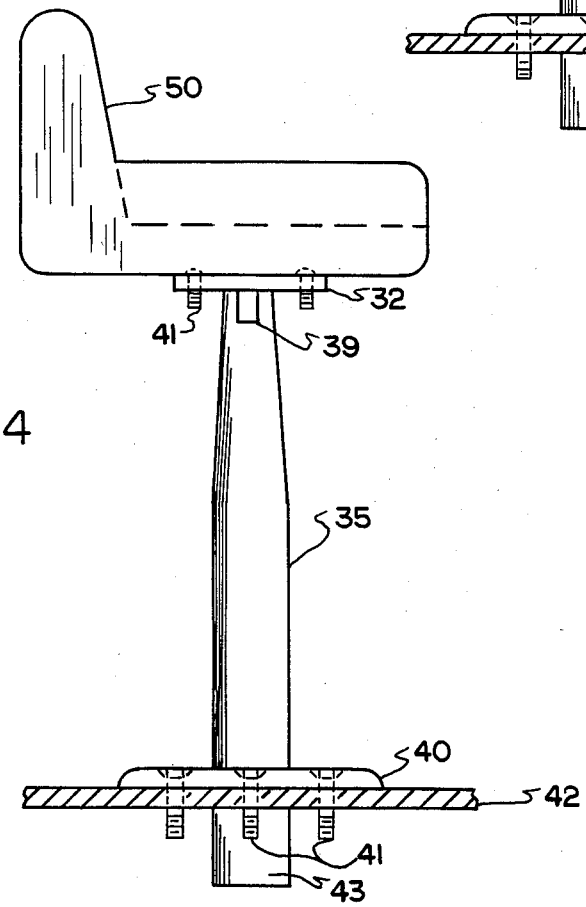
FIG. 4 is a side view of the pylon with the fishing seat attached.

FIG. 4 illustrates the base 35 with a fishing seat 50 attached thereto. The fishing seat 50 is mounted upon a mounting plate 32 of a polygonal shape, preferably rectangular or circular. The plate 32 has a plurality of equally spaced holes for mounting the seat 50 to the plate 32 as by bolts 41. In the center of the plate 32 a seat pin 39 is attached by conventional means, such as welding. The seat pin 39 enables the seat 50 to be mounted to the base 35 for fishing. The seat pin 39 is a cylindrical threaded member, threadedly received in a bore in the upper end of the pylon base 35, as shown.

Figure 5:
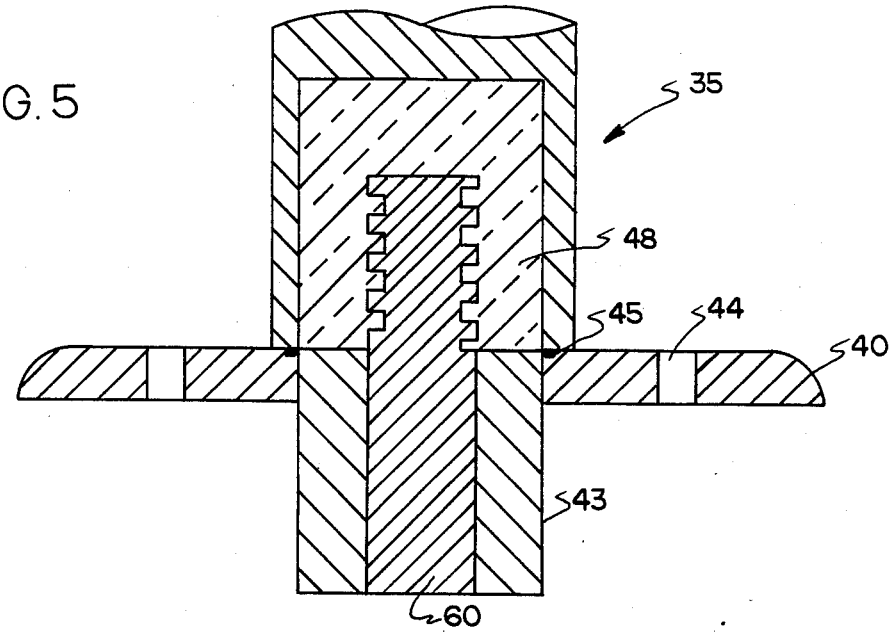
FIG. 5 is a fragmentary cross-sectional view of the mounting apparatus in a hollow pylon.

FIG. 5 is an illustration of the hollow pylon mounting apparatus. A pylon sleeve 48 is received by the pylon 30 at bottom thereof. The pylon sleeve 48 is a cylindrical member with a threaded bore in its center enabling the pin 60 to be screwed into the pylon 30. The pylon sleeve 48 is securely received in the bottom of the pylon 30 by a tight slip fit. This then enables the pylon 30 to be inserted into the mounting base plate 40 which has been described with respect to FIG. 2. Also, a spacer can be inserted between the pylon 30 and the mounting base plate 40 which aids in raising the height of the fishing seat pylon.

Figure 6:
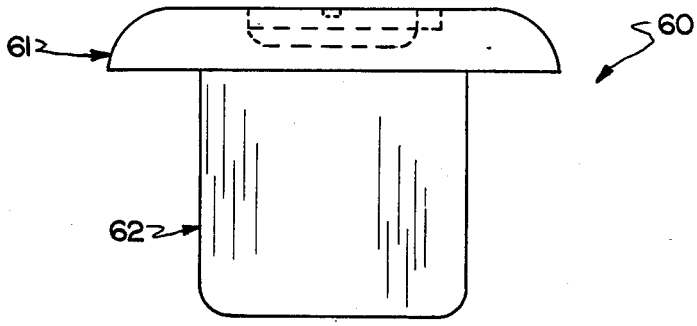
FIG. 6 is a side view of the pylon cover.

FIG. 6 is a side view of the pylon cover 60. The cover 60 comprises two members. The top 61 is circular and beveled on its outer edges. The bottom 62 is cylindrical. The top 61 and bottom 62 can be of a one or two-piece construction. In the latter instance, they are attached by conventional means.

Figure 7:
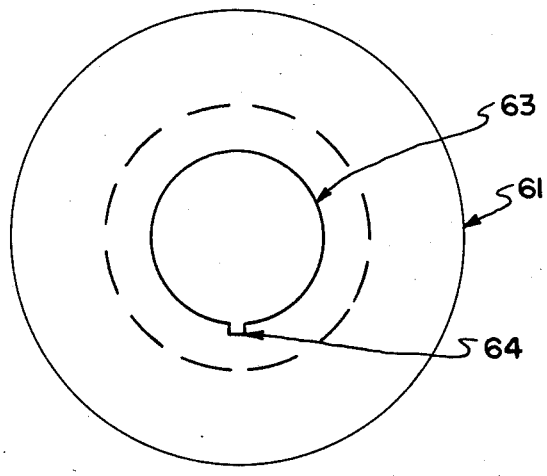
FIG. 7 is a top view of the pylon cover.

In FIG. 7, it can be seen that the top 61 has a hole 63 and a key way 64 bored thereinto. This enables easy removal and insertion into the mounting sleeve 43. The diameter of the top 61 is such that, when the top 61 is inserted into the mounting sleeve 43, the top is in flush contact with the base plate 40. This flush contact allows the base plate 40 to be walked upon, covered over, and protects the mounting sleeve 40 when the pylon 30 is not being used.

The diamter of the bottom 62 is such that it is slip fit into the mounting sleeve 43. The bottom 62 can be of solid or hollow construction, but preferably hollow for economy.

It will be appreciated that the cap 31 of FIG. 1 may be threadedly received by the pylon, in which case the pylon may serve in a dual capacity: receiving the cap 31 for skiing, or the seat 50 for fishing. In such case, the pylon would have to be of suitable height to accommodate both functions.

Certain modifications may be made to the design, and dimensions and proportions of different parts of the instant invention as described and illustrated herein without departing from the scope and spirit of said invention. Accordingly, the true scope and breadth of the invention is set forth in the appended claims.

What is claimed is:

1. A water ski tow assembly for installation in a boat, comprising:

a cylindrical resilient pylon of two-piece construction, said pylon being tapered from its mounting end to an apex, said apex being a hemispherical cap;

a mounting base plate, said pylon being adapted to be mounted on said base plate and said base plate being adapted to be mounted on a floor of the boat; and wherein said two pieces of said pylon are adapted to be separated and a fishing seat apparatus is adapted to be mounted to a base portion of said pylon upon removal of a top portion thereof.

2. A water ski tow assembly as recited in claim 1, wherein said cylindrical resilient pylon is hollow.

3. A water ski tow assembly as recited in claim 1, wherein said mounting base plate is a circular ring.

4. A water ski tow assembly as recited in claim 3, wherein said mounting base plate comprises a plurality of equally spaced perforations in said circular ring.

5. A water ski tow assembly as recited in claim 4, wherein said mounting base plate has a cylindrical mounting sleeve attached to said circular ring.

6. A water ski tow assembly as recited in claim 5 which further includes a pylon cover comprising:

a circular top portion; and a cylindrical bottom portion, adapted to be received by said cylindrical mounting sleeve.

7. A water ski tow assembly as recited in claim 6, wherein said circular top portion is beveled around the edges.

8. A water ski tow assembly as recited in claim 7, wherein said circular top portion has a hole and key way bored thereinto.

* * * * *